US009393676B2

(12) United States Patent
Weber

(10) Patent No.: US 9,393,676 B2
(45) Date of Patent: Jul. 19, 2016

(54) RATCHET LINE WRENCH TOOL

(71) Applicant: Webermatic Tool Company, LLC, Chester Springs, PA (US)

(72) Inventor: Mark Andrew Weber, Chester Springs, PA (US)

(73) Assignee: Webermatic Tool Company, LLC, Chester Springs, PA (US)

( * ) Notice: Subject to any disclaimer, the term of this patent is extended or adjusted under 35 U.S.C. 154(b) by 224 days.

(21) Appl. No.: 14/087,443

(22) Filed: Nov. 22, 2013

(65) Prior Publication Data

US 2015/0143961 A1 May 28, 2015

(51) Int. Cl.

| | |
|---|---|
| ***B25B 13/00*** | (2006.01) |
| ***B25B 13/46*** | (2006.01) |
| ***B25B 13/48*** | (2006.01) |
| ***B25B 13/04*** | (2006.01) |
| ***B25B 13/08*** | (2006.01) |

(52) U.S. Cl.

CPC ..... *B25B 13/463* (2013.01); *B25B 13/04* (2013.01); *B25B 13/08* (2013.01); *B25B 13/481* (2013.01)

(58) Field of Classification Search

CPC ..... B25B 13/02; B25B 13/06; B25B 13/00; B25B 13/58; B25B 13/08; B25B 23/0007; B25B 23/0028; B25B 13/473; B25B 13/04; B25B 13/481

USPC ..... 81/121.1, 98, 124.3, 119, 120, 180.1, 81/185.1, 185.2, 58.2, 177.8, 177.7

See application file for complete search history.

(56) References Cited

U.S. PATENT DOCUMENTS

| | | | | | |
|---|---|---|---|---|---|
| 1,352,461 | A | * | 9/1920 | Lenholt | B25B 13/08 81/125 |
| 1,550,436 | A | * | 8/1925 | Hall | B25B 13/08 81/119 |
| 1,646,350 | A | * | 10/1927 | De Hertelendy | B25B 13/107 81/186 |
| 1,890,213 | A | * | 12/1932 | Cameron | B21F 15/00 140/119 |
| 2,368,902 | A | * | 2/1945 | Thompson | B25B 13/06 81/125 |
| 2,521,419 | A | | 9/1950 | Sellers | |

(Continued)

FOREIGN PATENT DOCUMENTS

WO WO-2010/013014 A2 2/2010

*Primary Examiner* — Monica Carter
*Assistant Examiner* — Melanie Alexander
(74) *Attorney, Agent, or Firm* — Drinker Biddle & Reath LLP

(57) ABSTRACT

A ratchet line wrench tool includes a generally open head member and a handle connected thereto. The head member has a generally C-shape with an open portion on one end and an inner hollow portion. The head member further includes a ratchet gear having a generally C-shape with an open portion on one end that corresponds to the open portion of the head member and a plurality of outer surface teeth along an outer surface of the ratchet gear. The head member further includes a ratchet pawl disposed within the head member and engaging with the outer surface teeth enabling coupled rotation of the ratchet gear. The ratchet line further includes a removable tool insert having an insert portion having outer surface teeth and being sized and configured to close the open portion of the ratchet gear.

17 Claims, 8 Drawing Sheets

(56) References Cited

U.S. PATENT DOCUMENTS 2,567,352 A * 9/1951 Rozmus ..... B25B 23/10 81/125
2,954,715 A 10/1960 Wycech
3,541,897 A * 11/1970 Horton ..... E21B 19/164 81/57.18
4,374,479 A * 2/1983 Minotti ..... B25B 13/06 81/57.3
4,515,044 A * 5/1985 Harstad ..... B25B 13/58 81/61
4,787,273 A * 11/1988 Griffith ..... B25B 13/04 81/125
4,926,720 A * 5/1990 Srzanna ..... B25B 13/463 81/61
4,928,558 A * 5/1990 Makhlouf ..... B25B 13/481 81/57.13
5,454,283 A 10/1995 Stefano
5,467,672 A * 11/1995 Ashby ..... B25B 13/463 81/58.2
5,924,341 A 7/1999 Brooks
6,089,127 A * 7/2000 Dominguez ..... B25B 13/04 81/119
D481,275 S * 10/2003 Black ..... D8/21
D504,057 S * 4/2005 Tuanmu ..... D8/25
7,162,938 B1 * 1/2007 Peters ..... B25B 23/12 81/125
7,249,539 B2 7/2007 Decaprio
2006/0288822 A1 12/2006 Langas
2010/0212461 A1 * 8/2010 Burt ..... B25B 13/04 81/58.2
2010/0251859 A1 * 10/2010 Gapp ..... B25B 13/463 81/63
2014/0033880 A1 * 2/2014 Hill ..... B25B 13/04 81/121.1

* cited by examiner

FIG. 7A
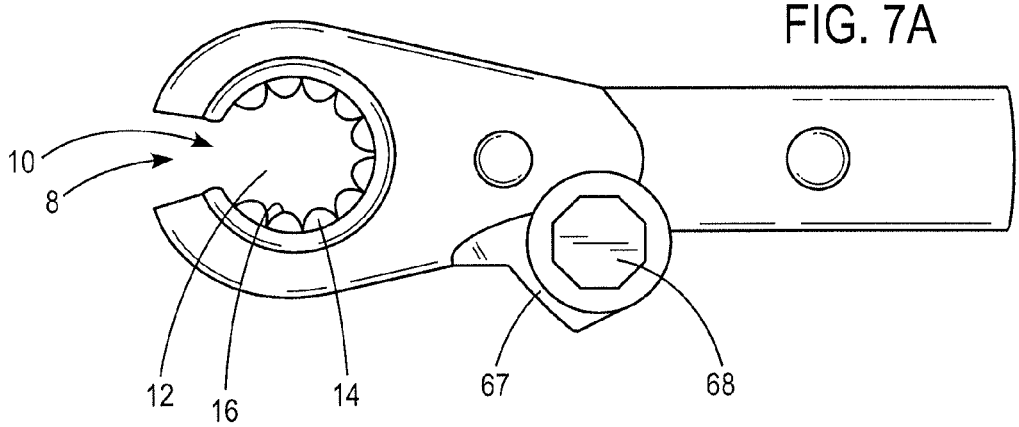
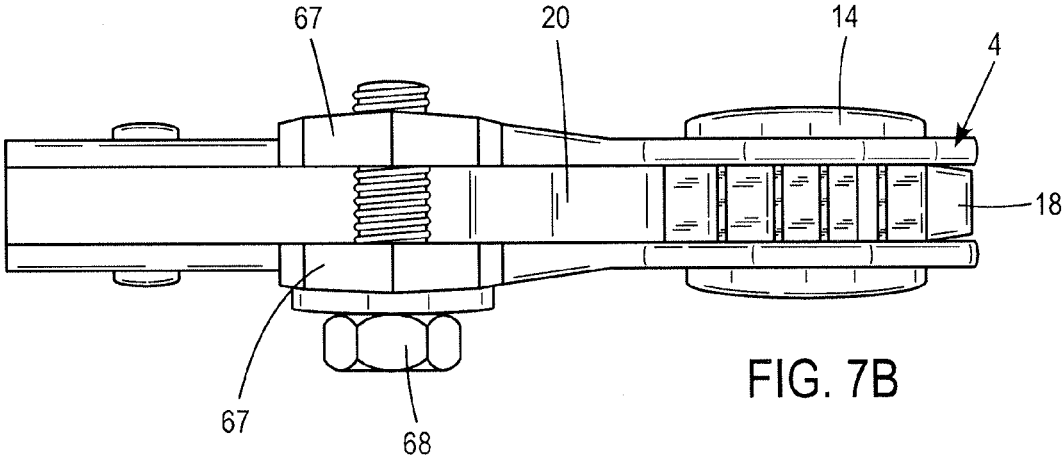
FIG. 7B
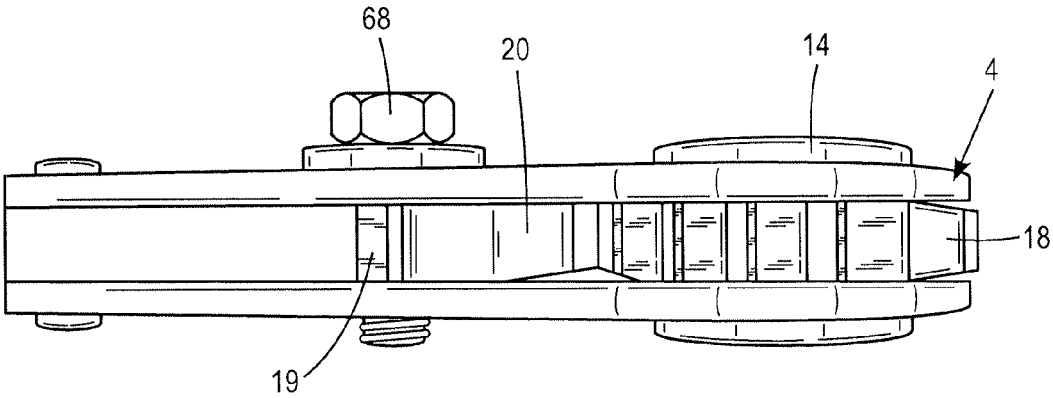
FIG. 7C

FIG. 9
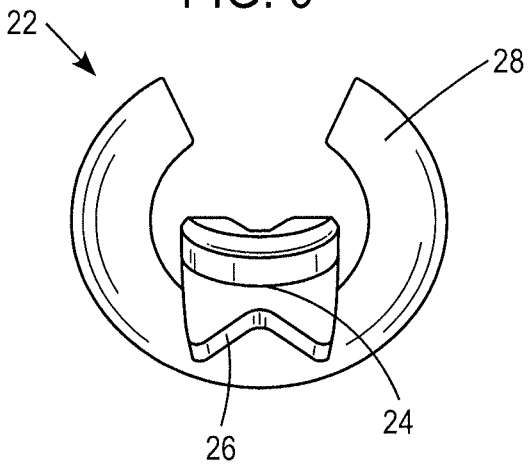
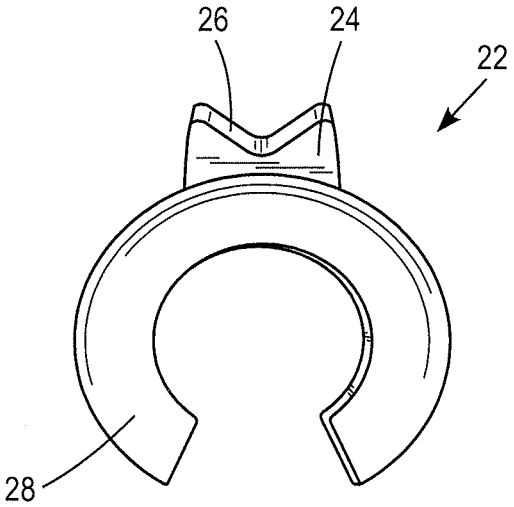
FIG. 10

RATCHET LINE WRENCH TOOL

TECHNICAL FIELD

The present disclosure relates to a ratchet line wrench tool. The tool includes a ratcheting system with a ratchet gear that is open on one end prior to insertion of an insert that completes the ring shape of the ratchet gear. The tool can be used in a method of attaching or removing line-through-bolts, such as on many hydraulic lines including, for example, automotive brake lines.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

The attachment or removal of line-through-bolts, such as for a fuel line or hydraulic line such as an automotive brake line, requires employment of an open ended wrench to accommodate a tubing which extends from one end of the line connector. A typical open ended wrench is removed and reapplied several times as the wrench can only engage the fastening nut in a direction which is generally perpendicular to the axis of the tubing and where such direction further coincides with the plane of the nut. Further, wrenches sufficient to break loose or tighten fasteners for fuel lines or hydraulic lines typically require the end of the wrench to grip more than half of the sides of the fastening nut, and preferably all of the sides of the fastening nut. Thus, for providing adequate grip on the fastening nut and sufficient torque for removal or attachment, a closed box-end wrench is preferred. However, conventional ratchet wrenches having a closed head cannot be used for line-through-bolts, because they require axially unobstructed access to the fastening nut. Existing ratchet line wrench tools, due to design, do not stay fully engaged on fastener for all 360 degrees.

Examples of ratchet line wrench tools are shown in U.S. Pat. Nos. 5,454,283 and 7,249,539 and U.S. Patent Application Publication No. 2006/0288822. None of these references solve all of the problems discussed above with previous wrenches for line-through-bolts.

SUMMARY

It has been discovered that an open ended ratchet wrench as described below can achieve the above-mentioned combination of having adequate grip on a fastening nut and sufficient torque for removal or attachment of a fastening nut while also being able to access the fastening nut through the tubing which extends from one end of the fastening nut.

An exemplary tool includes a first head member, a handle connected to the head member, a ratchet gear, a ratchet pawl, and a removable tool insert. The first head member has a generally C-shape with an open portion on one end and an inner hollow portion. The ratchet gear is disposed within the first head member and has a generally C-shape with an open portion on one end that corresponds to the open portion of the first head member and a plurality of outer surface teeth along an outer surface of the ratchet gear. The ratchet pawl is disposed within the first head member and engages with said outer surface teeth enabling coupled rotation of the ratchet gear. The removable tool insert has an insert portion having outer surface teeth and is sized and configured to close the open portion of the ratchet gear.

A further feature that applies to the exemplary tool described above is the incorporation of a retaining member configured to lock the tool insert into a position that closes the open portion of the ratchet gear.

Yet a further feature that applies to the exemplary tools described above is that the ratchet gear can include a ring extension on the top surface of the ratchet gear. The ring extension extends inward toward the opening in the ratchet gear such that it covers the inner teeth of the ratchet gear when the tool is viewed from the top.

Yet a further feature that applies to the exemplary tools described above is that the tool insert can also include a ring portion positioned outside the outer surface of the first head member.

Yet another feature that applies to the exemplary tools described above is the incorporation of magnets for holding the tool insert in a position that closes the open portion of the ratchet gear. The magnets can be positioned on the first head member or on said ring portion of the tool insert or both.

Yet another feature that applies to the exemplary tools described above is the incorporation of a retaining member configured to press the ring portion of the tool insert against the first head member to lock the tool insert into a position that closes the open portion of the ratchet gear. The retaining member can be removably attached to the tool. In further embodiments, the retaining member can be removably attached to the handle by a pair of fasteners. In yet further embodiments, the retaining member pivots on the first fastener to a locking position, and the second fastener holds the retaining member in the locking position.

Yet another feature that applies to the exemplary tools described above is the incorporation of a retaining member that can be removably attached to the first head member by a fastener to press the ring portion of the tool insert against the first head member to lock the tool insert into a position that closes the open portion of the ratchet gear. In certain embodiments, the retaining member pivots on the fastener to a locking position.

Yet another feature that applies to the exemplary tools described above is the incorporation of a retaining member comprising a removable clip that clips the ring portion of the tool insert against the first head member to lock the tool insert into a position that closes the open portion of the ratchet gear.

Yet another feature that applies to the exemplary tools described above is that the ratchet gear can have a multi-faceted inner surface. In certain embodiments, the multi-faceted inner surface can have 4 points, 6 points, 8 points, 12 points, or a spline portion, with or without any additional faces on the removable insert tool.

Yet another feature that applies to the exemplary tools described above is the incorporation of a retainer to prevent the ratchet pawl from coming loose from the tool during removal or installation. In certain embodiments, the retainer can be a bolt. In more certain embodiments, tabs are formed on the handle to create a hole for the retainer bolt. In yet more certain embodiments, the tabs are formed on both sides of the handle to create a hole for a retainer bolt on either side of the ratchet pawl, which is especially helpful where the ratchet pawl is positioned in a central location between the edges of the tool to enable switching of the rotation direction of the ratchet gear without flipping the tool.

Yet another feature that applies to the exemplary tools described above is the incorporation of a second head member on the opposite end of the tool from said first head member. In certain embodiments, the second head member can include any of the features described above with regards to the first head member. In more certain embodiments, the second head member can have a different multi-faceted inner surface or a different size or both.

Yet another feature that applies to the exemplary tools described above is that head member(s) can be connected to the handle by a joint that allows the head to pivot with respect to the handle.

Yet another feature that applies to the exemplary tools described above is that head member(s) can be angled with respect to the handle.

Yet another feature that applies to the exemplary tools described above is that head member(s) can be offset from the handle such that the head member(s) is parallel to and in a different plane from the handle.

Yet another feature that applies to the exemplary tools described above is that the ratchet pawl is configured to allow coupled rotation of the ratchet gear in only a single direction with respect to the head member and the handle.

Yet another feature that applies to the exemplary tools described above is the incorporation of a switching mechanism and a second ratchet pawl that is configured to allow coupled rotation of the ratchet gear in only a single direction opposite to the direction allowed by the first ratchet pawl, wherein, at any one time, only one of the ratchet pawls engages with the ratchet gear, and wherein the ratchet pawl that is engaged can be switched by said switching mechanism.

An exemplary tool includes a tool according to any of the embodiments described above.

It is to be understood that both the foregoing general description and the following detailed description are exemplary and explanatory and are intended to provide further explanation of the invention as claimed.

BRIEF DESCRIPTION OF THE DRAWINGS

The following detailed description can be read in connection with the accompanying drawings in which like numerals designate like elements and in which:

FIG. 7A illustrates a top view of another exemplary embodiment of a tool according to features of the invention.

FIG. 7B illustrates a side view of the tool of FIG. 7A.

FIG. 7C illustrates another side view of the tool of FIG. 7A.

FIG. 9 illustrates a bottom view of the tool insert in the tool illustrated in FIG. 8B.

FIG. 10 illustrates a perspective view of the tool insert in the tool illustrated in FIG. 8B.

DETAILED DESCRIPTION OF PREFERRED EMBODIMENTS

Figure 1:
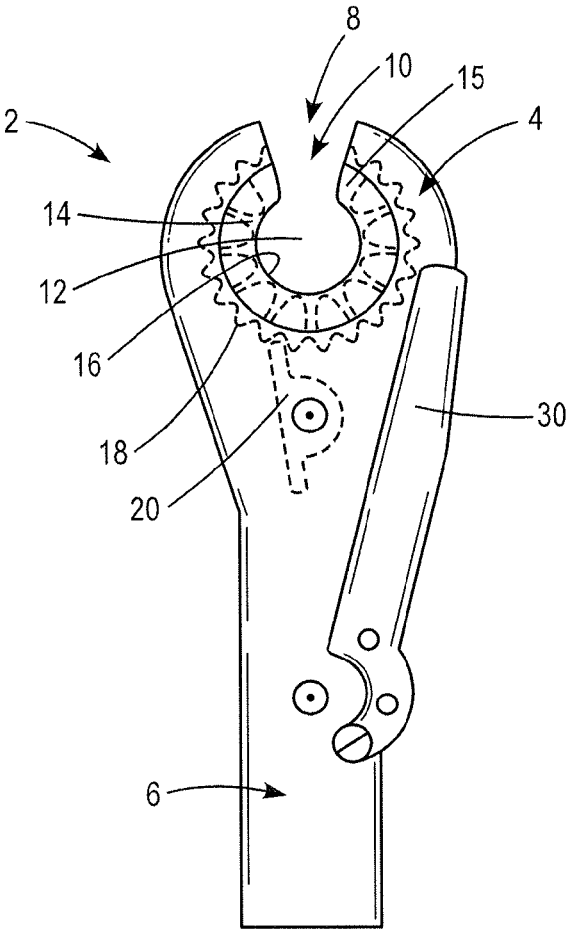
FIG. 1 illustrates a top view of an exemplary embodiment of a tool according to features of the invention.

An exemplary embodiment of a ratchet line wrench tool is shown in FIGS. 1 and 8A-10. The tool 2 includes a head member 4 connected to a handle 6. The head member 4 has a generally C-shape and an open portion 8 on one end and an inner hollow portion 12. A ratchet gear 14 is disposed within the head member 4. The ratchet gear 14 has a generally C-shape with an open portion 10 on one end that corresponds to the open portion 8 of the head member. The ratchet gear 14 has a plurality of outer surface teeth 18 (below top surface of head member 4, but illustrated with hidden lines in FIG. 1) along an outer surface of the ratchet gear, and a plurality of inner teeth 16 along an inner surface of the ratchet gear. The ratchet gear, as illustrated in FIG. 1, further includes ring extension 15 on the top surface of the ratchet gear that extends inward towards the opening in the ratchet gear so that it covers the inner teeth 16 when the tool is viewed from the top as illustrated in FIG. 1. The ring extension 15 of the ratchet gear can assist in providing forward provided pressure on the nut when installing a brake line, so that the bolt can be "started" with the tool, instead of the initial turns being made by hand, where the tool does not include such a ring extension. A ratchet pawl 20 (below top surface of head member 4, but illustrated with hidden lines in FIG. 1) is also disposed in the head member and engages with said outer surface teeth 18 to enable coupled rotation of the ratchet gear 14. A spring 19 illustrated in FIG. 8C enables the ratchet pawl 20 to spring back toward the next tooth as the ratchet gear 14 is rotated.

The ratchet line wrench tool illustrated in FIG. 1 also includes a removable tool insert 22 that has been removed. An exemplary embodiment of a tool insert 22 is illustrated in FIGS. 9 and 10. The removable tool insert 22 has an insert portion 24 having outer surface teeth 26 similar in size and shape to the outer surface teeth 18 of the ratchet gear 14. The removable tool insert 22 is sized and configured to be inserted into the open portion 10 of the ratchet gear so as to close the open portion 10. The combination of a removable tool insert and an open portion of the ratchet gear, which is filled by the removable tool insert enables the ratchet line wrench tool according to the invention to maintain a fully enclosed ratchet mechanism when removing or attaching a fastener, while also being able to access the fastener by passing the tubing attached to the fastener through the open portion of the ratchet gear when the tool insert is removed.

The removable tool insert 22 also includes a ring portion 28. The ring portion 28 is positioned outside the head member when the removable tool insert is in a position that closes the open portion 10 of the ratchet gear. The ring portion helps to hold the removable tool insert in place and prevents the insert portion of the removable tool insert from sliding back out during ratcheting or knocking the tool or attachment around in tight spaces. Although the ring portion is illustrated with a C-shape, other shapes, including a complete circle are also contemplated.

The ratchet line wrench tool illustrated in FIG. 1 also includes a retaining member 30 that locks a removable tool insert into a position that closes the open portion of the ratchet gear. The retaining member 30 is a thin strip having a distal end 32 that comes in contact with the ring portion 28 of the removable tool insert, a proximal end 36 where the retaining member is attached to the handle 6, and an offset curve 34 that puts the distal end 32 in a different plane from the proximal end 36. At the proximal end 36, the retaining member 30 is attached by a pair of fasteners 38, 40. The first fastener 38, when fastened, allows the retaining member 30 to pivot on and off the ring portion 28 of the removable tool insert. The second fastener 40, when fastened, locks the retaining member in a position where it engages the ring portion 28 so as to lock the removable tool insert into the position where the insert portion 24 closes the open portion 10 of the ratchet gear.

Figure 2:
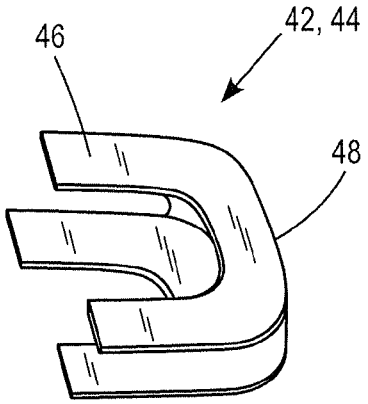
FIG. 2 illustrates a perspective view of an exemplary retaining member for use in another exemplary embodiment of a tool according to features of the invention.

FIG. 2 illustrates an alternative retaining member 42, which comprises a removable clip 44 that clips the ring portion 28 of the removable tool insert 22 against the head member 4. The clip 44 includes four feet 46 and a back 48 that connects an upper pair of feet and a lower pair of feet. The back 48 is bent to follow the arc on the outside edge of the head member 4. However, the removable clip 44 can have different shapes and different numbers of feet, for example 2, 3, 5, or 6.

Figure 3:
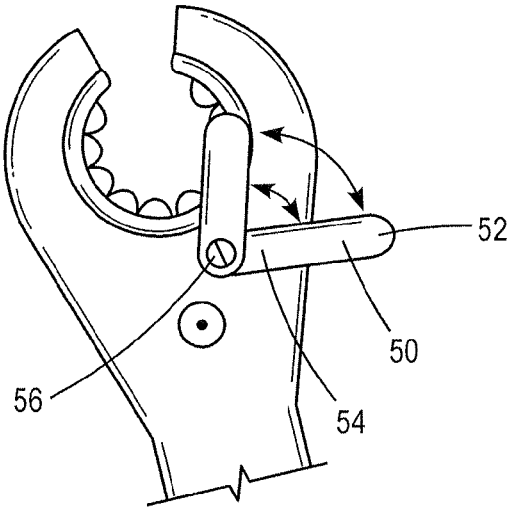
FIG. 3 illustrates a top view of another exemplary embodiment of a tool according to features of the invention.
Figure 4:
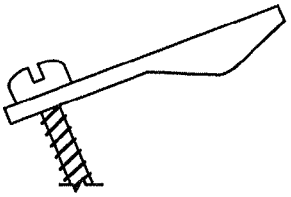
FIG. 4 illustrates a side view of the retaining member in the tool illustrated in FIG. 3.

FIGS. 3 and 4 illustrate yet another alternative retaining member 50, which comprises a thin strip having a distal end 52 that comes in contact with the ring portion 28 of the removable tool insert and a proximal end 54 where the retaining member 50 is attached to the head member 4. At the proximal end 54, the retaining member 50 is attached by a fastener 56, which allows the retaining member 50 to pivot on and off the ring portion 28 of the removable tool insert. When the distal end 52 is in contact with the ring portion 28 of the removable tool insert, it locks the removable tool insert into the position where the insert portion 24 closes the open portion 10 of the ratchet gear.

Figure 5:
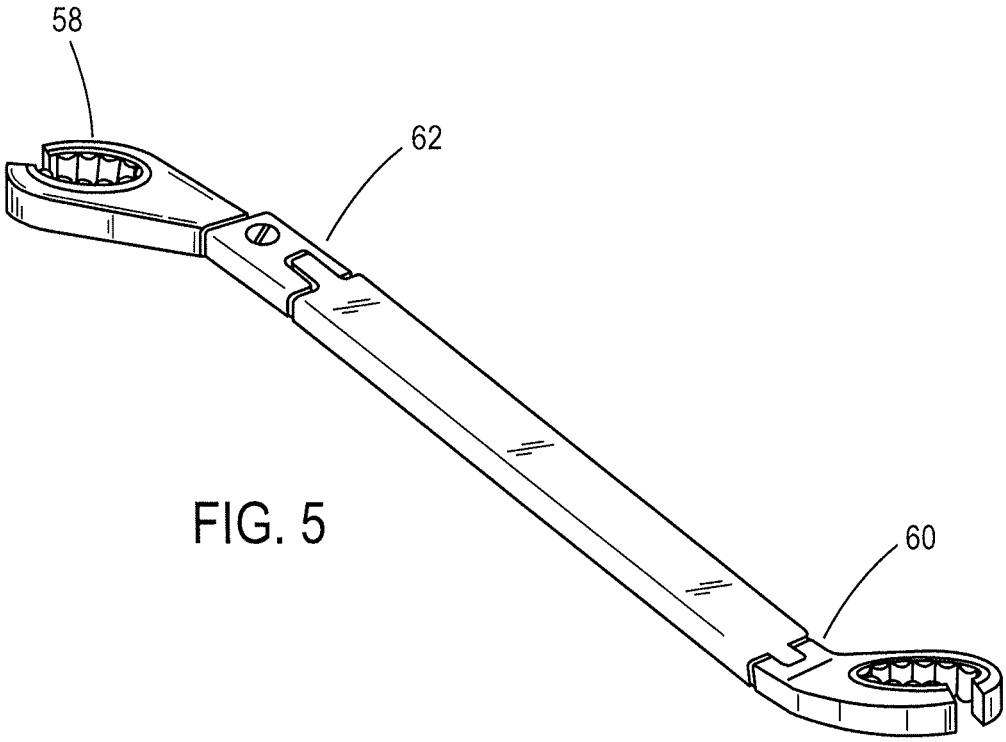
FIG. 5 illustrates a perspective view of another exemplary embodiment of a tool according to features of the invention.

FIG. 5 illustrates an embodiment of the ratchet line wrench tool in which a second head member 58 is located on the opposite end of the tool from said first head member 4. The tool illustrated in FIG. 5 also includes a pivot joint 60 connecting the head member and handle that allows the head to pivot with respect to the handle. The pivot joint 60 can also be left flexible or locked. The second head member is illustrated in FIG. 5 as connected to the handle by a double pivot joint 62, in which the joint can pivot in two opposite directions to assist in positioning the head member with respect to the fastening nut to be tightened or loosened and the handle 6.

Figure 6:
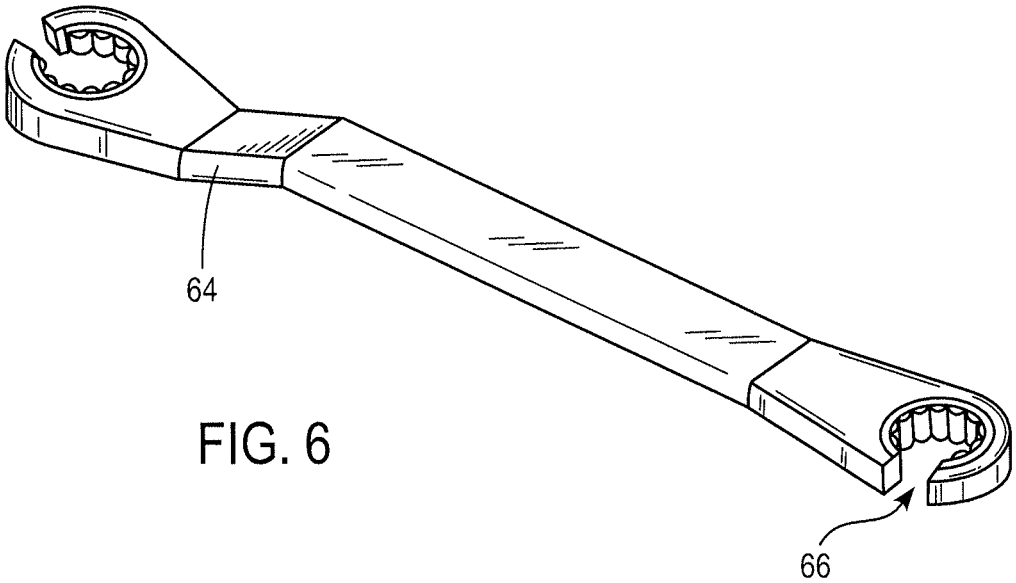
FIG. 6 illustrates a perspective view of another exemplary embodiment of a tool according to features of the invention.
Figure 8A:
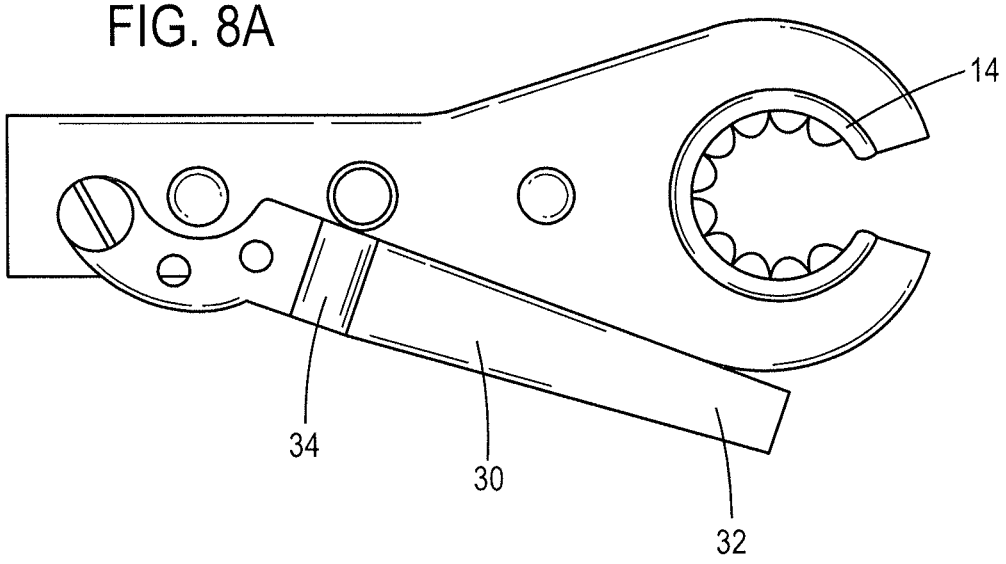
FIG. 8A illustrates a top view of another exemplary embodiment of a tool according to features of the invention.
Figure 8B:
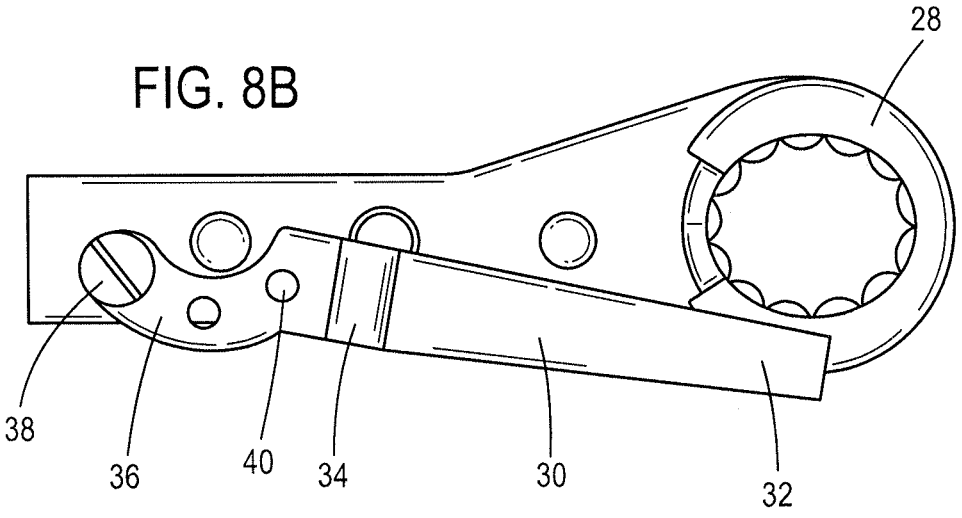
FIG. 8B illustrates a top view of the tool of FIG. 8A with a removable tool insert.
Figure 8C:
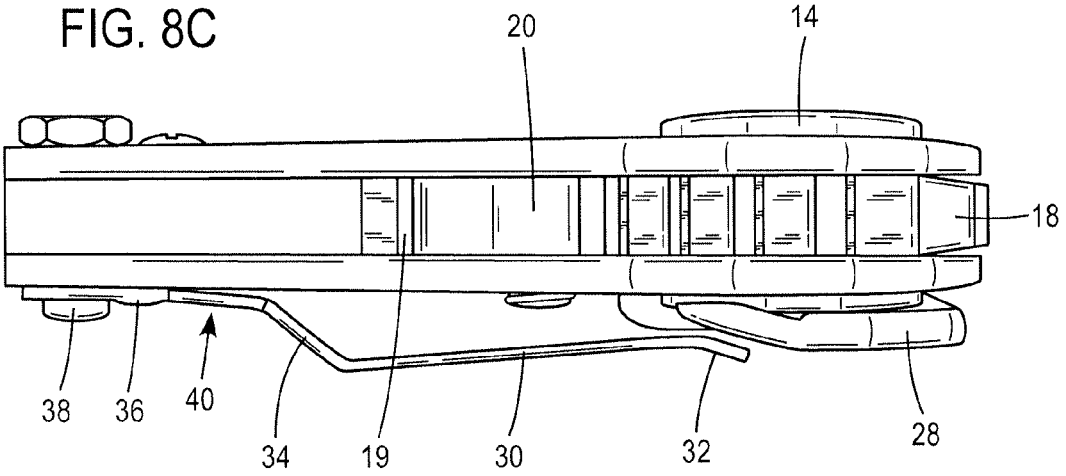
FIG. 8C illustrates a side view of the tool of FIG. 8B with a removable tool insert.
Figure 8D:
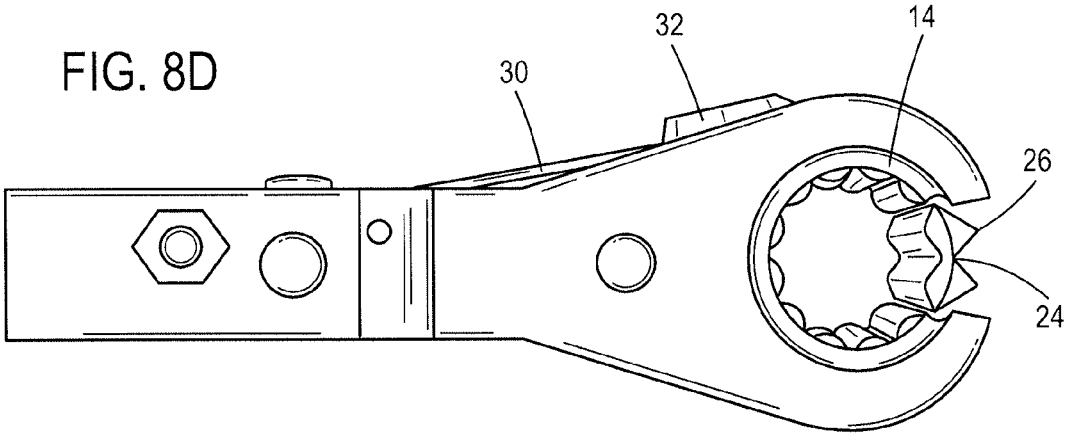
FIG. 8D illustrates a bottom view of the tool of FIG. 8B with a removable tool insert.

FIG. 6 illustrates an embodiment of the ratchet line wrench tool that includes an angled joint 64 connecting the head member and handle. The angled joint 64 is fixed at an angle with respect to the head member and the handle such that the head member and handle are parallel but in different planes. The tool illustrated in FIG. 6 also includes a second head member where the open portion 66 of the head member is perpendicular to the longitudinal direction of the tool. Although the open portion of the head member is illustrated in the figures as either parallel or perpendicular to the longitudinal direction of the tool, other angles in between are also contemplated, such as 45°.

The ratchet line wrench tool illustrated in FIGS. 7A-C includes a removable retainer 68 to prevent the ratchet pawl from coming loose from the tool during removal or installation. The removable retainer 68 as illustrated in FIGS. 7A-C is a removable bolt. In the illustrated embodiment, an outer tab or ear 67 is provided on one side of the tool, and a threaded hole is formed between the outer tab or ear 67 and the side of the tool for connection of the removable bolt. In further embodiments, the tool can include an additional outer tab or ear (not illustrated) on the opposite side of the tool from the outer tab or ear 67. The removable bolt or removable retainer can be threaded into either the threaded hole formed between the outer tab or ear 67 and the side of the tool or in the threaded hole formed between the additional outer tab or ear and the other side of the tool depending on whether clockwise/tightening or counterclockwise/loosening is desired.

Figure 11:
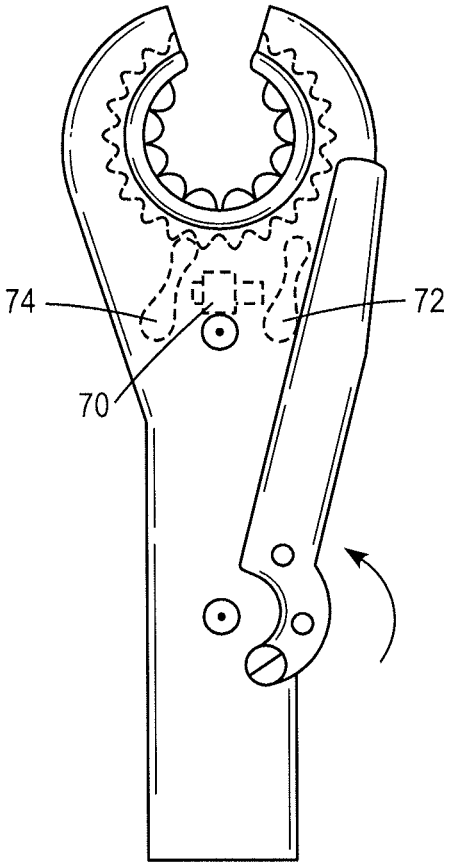
FIG. 11 illustrates a top view of another exemplary embodiment of a tool according to features of the invention.

The ratchet line wrench tool illustrated in FIG. 11 enables reverse rotation for tightening and loosening a fastening nut without removing and reapplying the tool. The tool includes a switching mechanism 70 and two ratchet pawls 72, 74. Each of the ratchet pawls 72, 74 engage the ratchet gear at different times based on which ratchet pawl is engaged by the switching mechanism. Each of the ratchet pawls only allow coupled rotation in a single direction with ratchet pawl 72 allowing rotation in the direction opposite to the direction allowed by ratchet pawl 74.

Figure 12:
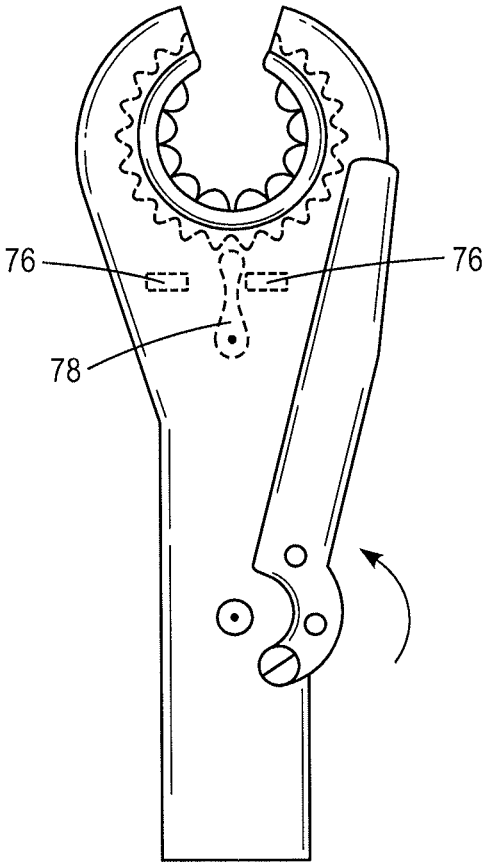
FIG. 12 illustrates a top view of another exemplary embodiment of a tool according to features of the invention.

The ratchet line wrench tool illustrated in FIG. 12 enables reverse rotation for tightening and loosening a fastening nut without removing and reapplying the tool. The tool includes a switching mechanism 76 and a ratchet pawl 78. The ratchet pawl 78 is centrally located between the sides of the tool. The switching mechanism switches the direction in which the ratchet pawl 78 is locked so that at any one time the ratchet pawl only allows coupled rotation of the ratchet gear in a single direction, but is able to allow coupled rotation in the opposite direction when locked in the other direction.

Figure 13:
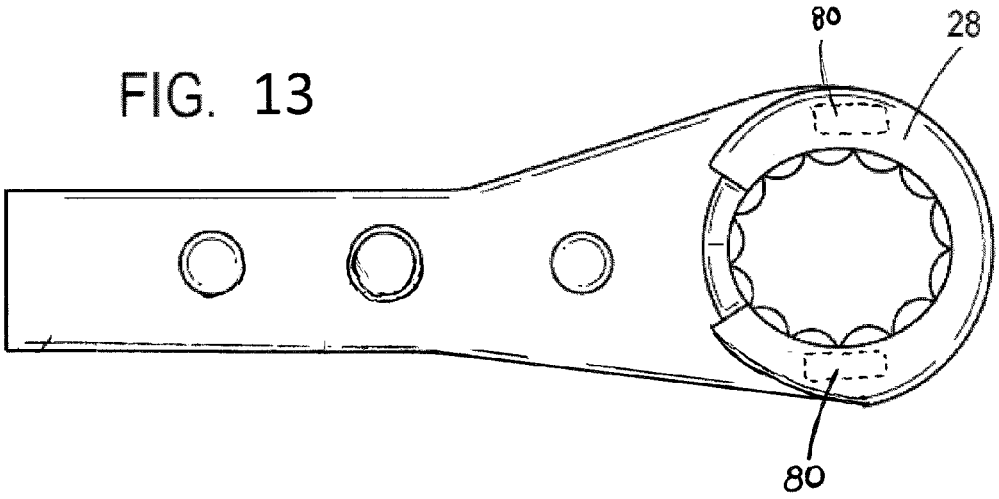
FIG. 13 illustrates a top view of another exemplary embodiment of a tool according to features of the invention.

The ratchet line wrench tool illustrated in FIG. 13 includes an alternative retaining member 80, which comprises magnets on said first head member or on said ring portion to hold the tool insert in a position that closes the open portion ratchet gear.

Although illustrated in separate figures, any features illustrated and described within one figure or embodiment could be substituted or added to any of the other embodiments described above. For example, any feature illustrated and described with regard to a single head member can be incorporated in both a first and second head member for tools containing two head members. The features for the first and second head members can be different from each other in the same tool.

Although described in connection with preferred embodiments thereof, it will be appreciated by those skilled in the art that additions, deletions, modifications, and substitutions not specifically described may be made without departure from the spirit and scope of the invention as defined in the appended claims.

What is claimed is:

1. A tool comprising:

a first head member having a generally C-shape with an open portion on one end, an inner hollow portion, and opposing upper and lower surfaces;

a handle connected to said head member;

a ratchet gear disposed within said first head member and having a generally C-shape with an open portion on one end that corresponds to the open portion of said first head member and a plurality of outer surface teeth along an outer surface of said ratchet gear, wherein the plurality of outer surface teeth are disposed between the opposing upper and lower surfaces of the first head member;

a ratchet pawl disposed within said first head member and engaging with said outer surface teeth enabling coupled rotation of said ratchet gear;

a removable tool insert having an insert portion having outer surface teeth and being sized and configured to close the open portion of the ratchet gear and a ring portion that overlaps either the upper surface or the lower surface of said first head member; and a retaining member configured to hold the ring portion of the tool insert against said first head member to lock the tool insert into a position that closes the open portion of the ratchet gear.

2. The tool according to claim 1, wherein the retaining member comprises magnets on said first head member or on said ring portion.

3. The tool according to claim 1, wherein the retaining member is configured to press the ring portion of the tool insert against said first head member to lock the tool insert into a position that closes the open portion of the ratchet gear.

4. The tool according to claim 3, wherein the retaining member is removably attached to the tool.

5. The tool according to claim 3, wherein the retaining member is removably attached to said handle by a pair of fasteners.

6. The tool according to claim 5, wherein the retaining member pivots on the first fastener to a locking position, and wherein the second fastener holds the retaining member in the locking position.

7. The tool according to claim 4, wherein the retaining member is removably attached to said first head member by a fastener, and wherein the retaining member pivots on the fastener to a locking position.

8. The tool according to claim 3, wherein the retaining member comprises a removable clip that clips the ring portion of the tool insert against said first head member.

9. The tool according to claim 1, wherein the ratchet gear has a multi-faceted inner surface.

10. The tool according to claim 1 further comprising a retainer to prevent said ratchet pawl from coming loose from the tool during removal or installation.

11. The tool according to claim 10, wherein the retainer comprises a removable bolt.

12. The tool according to claim 1 further comprising a second head member on the opposite end of the tool from said first head member.

13. The tool according to claim 1, wherein said first head member is connected to the handle by a joint that allows the head to pivot with respect to the handle.

14. The tool according to claim 1, wherein said first head member is angled with respect to the handle.

15. The tool according to claim 1, wherein said first head member is offset from said handle such that said first head member is parallel to and in a different plane from said handle.

16. The tool according to claim 1, wherein the said ratchet pawl is configured to allow coupled rotation of said ratchet gear in only a single direction with respect to said head member and said handle.

17. The tool according to claim 16 further comprising a switching mechanism and a second ratchet pawl that is configured to allow coupled rotation of said ratchet gear in only a single direction opposite to the direction allowed by said first ratchet pawl, wherein, at any one time, only one of the ratchet pawls engages with said ratchet gear, and wherein the ratchet pawl that is engaged can be switched by said switching mechanism.

* * * * *